US005877135A

United States Patent [19]

Hahn

[11] Patent Number: 5,877,135

[45] Date of Patent: Mar. 2, 1999

[54] THIXOTROPIC LIQUID SANITARY CLEANSER AND ITS USES

[75] Inventor: Holger Hahn, Hamburg, Germany

[73] Assignee: Yankee Polish Luth GmbH & Co., Reinbek, Germany

[21] Appl. No.: 809,281

[22] PCT Filed: Jul. 12, 1996

[86] PCT No.: PCT/EP96/03063

§ 371 Date: May 5, 1997

§ 102(e) Date: May 5, 1997

[87] PCT Pub. No.: WO97/04061

PCT Pub. Date: Feb. 6, 1997

[30] Foreign Application Priority Data

Jul. 16, 1995 [DE] Germany ..... 195 25 604.2

[51] Int. Cl.[6] ..... C11D 1/825; C11D 3/08

[52] U.S. Cl. ..... 510/238; 510/362; 510/421; 510/427; 510/434; 510/488; 510/499; 510/506

[58] Field of Search ..... 510/424, 417, 510/434, 238, 365, 421, 427, 506; 134/3

[56] References Cited

U.S. PATENT DOCUMENTS 5,460,742 10/1995 Cavanash et al. ..... 252/144

FOREIGN PATENT DOCUMENTS 0328182 8/1989 European Pat. Off. ..... C11D 3/12
0342786 11/1989 European Pat. Off. ..... C11D 1/90
0496188 7/1992 European Pat. Off. ..... C11D 3/20
3815291 11/1989 Germany ..... C11D 1/72
1193385 5/1970 United Kingdom ..... C11D 3/14
1572032 7/1980 United Kingdom ..... C01B 33/16

OTHER PUBLICATIONS

Database WPI, Sec. Ch, Week 8832, Derwent Pub. Ltd., JP 63 161 095, Jul. 4, 1988.
Database WPI, Sec. Ch, Week 7732, Derwent Pub. Ltd., JP 52 077 111, Jun. 29, 1977.
Database WPI, Sec. Ch, Week 8724, Derwent Pub. Ltd., JP 62 096 599, May 6, 1987.
Database WPI, Sec. Ch, Week 8832, Derwent Pub. Ltd., JP 63 161 091, Jul. 4, 1988.

*Primary Examiner*—Paul Lieberman
*Assistant Examiner*—Gregory E. Webb
*Attorney, Agent, or Firm*—Ladas & Parry

[57] ABSTRACT

The invention relates to a liquid cleanser with thixotrope properties and its use as a liquid sanitary cleaning agent, in particular for cleaning toilets, washbowls, shower cabinets, shower tubs and swimming pools as well as kitchen sinks.

The liquid cleanser contains along with usual cleanser additives in aqueous solution as a surface-active agent one or more compounds selected from the group of alkylamidobetaines, alkylaminobetaines, alkylbetaines, alkyl polyglycol ether carboxylic acids and/or fatty alcohol ethoxylates in mixture with pyrogenic silicic acid and at least one organic acid selected from the group of citric acid, lactic acid, tartaric acid, maleic acid, malic acid, glutaric acid, adipic acid, acetic acid and formic acid.

17 Claims, No Drawings

THIXOTROPIC LIQUID SANITARY CLEANSER AND ITS USES

This invention relates to a liquid cleanser with thixotrope properties which contains a surface-active agent and an organic acid along with usual cleanser additives in aqueous solution, and to its use as a liquid sanitary cleaning agent, in particular for cleaning toilets, washbowls, shower cabinets, shower tubs and swimming pools as well as kitchen sinks.

Conventional acidic liquid toilet cleaning agents contain along with surface-active agents substantially organic acids (e.g. formic acid, acetic acid or citric acid) or inorganic acids (e.g. phosphoric acid or hydrochloric acid) and polysaccharides as thickening agents as well as usual further additives such as stabilizers, dyes and scents.

Known acidic liquid toilet cleaning agents are effective for example in removing lime and urine deposits as well as in destroying bacteria and bad smells which form predominantly on the lime and urine deposits.

The most frequently used relatively strong acids, such as hydrochloric acid, phosphoric acid and formic acid, belong to water danger class 1. Phosphoric acid furthermore has a eutrophic effect. Hydrochloric acid and formic acid are considered strong irritants for the eyes, respiratory tract and mucous membranes so that liquid toilet cleansers containing these acids can already be recognized by their keen and sharp smell. The stated strong acids are furthermore very difficult to perfume. Inorganic acids and formic acid therefore involve a potential danger because of their corrosive effect and should not be used for household cleaning agents if possible.

The thickening agents contained in known toilet cleaning agents are intended to increase the viscosity of the cleaning agent and ensure that the acidic cleaning solution can act as long as possible on the vertical surfaces of a toilet bowl.

However, the viscosity of a toilet cleanser cannot be increased at will, the lime solvent power decreasing with increasing viscosity as a result of diffusion problems of its lime-dissolving components on the toilet surface to be treated, and problems furthermore occurring with respect to the distribution of the cleanser, which becomes more difficult with increasing viscosity. This limits the exposure time and the exposure concentration of the lime-dissolving components of the toilet cleansers and thus their cleaning power, in particular their lime solvent power (LSP).

The problem of the invention was therefore to develop an improved liquid cleanser which has a higher cleaning power, in particular improved lime solvent power, while using weaker, less polluting acids without the abovementioned problems occurring.

It was found that this problem can be solved by considerably improving the adhesion of a sufficiently thick cleaning film to the surface to be cleaned by using pyrogenic silicic acid, which in combination with certain organic acids and surface-active agents gives the liquid cleaning agent thixotrope properties.

It was surprisingly found in particular that thixotropic acidic aqueous cleaning solutions (containing organic carboxylic acids) with clearly higher lime solvent power can be obtained with various surface-active agents, based on the same active content, and pyrogenic silicic acid.

The subject-matter of the invention is a liquid cleanser with thixotrope properties which contains a surface-active agent and an organic acid along with usual cleanser additives in aqueous solution, characterized in that it contains as a surface-active agent one or more compounds selected from the group of alkylamidobetaines, alkylaminobetaines, alkylbetaines, alkyl polyglycol ether carboxylic acids and/or fatty alcohol ethoxylates in mixture with pyrogenic silicic acid and at least one organic acid selected from the group of citric acid, lactic acid, tartaric acid, maleic acid, malic acid, glutaric acid, adipic acid, acetic acid and formic acid.

The surface-active agents to be used according to the invention are ones whose alkyl group or fatty acid group is a saturated or unsaturated alkyl group with 10 to 18, preferable 12 to 14, carbon atoms, and the alkyl polyglycol ether carboxylic acids and/or fatty alcohol ethoxylates used as surface-active agents preferably contain 2 to 15, in particular 3 to 7, specifically 3, ethylene oxide units per molecule.

An especially advantageous surface-active agent is alkylamidopropyl betaine, which is preferably used in 30% form.

Of the abovementioned organic acids, citric acid is especially advantageous.

The pyrogenic silicic acid preferably used according to the invention is Aerosil, in particular a type 200 one, and/or Cab-o-Sil, in particular a type M5 one.

The inventive liquid cleanser can additionally contain glycol and optionally one or more preservatives, in particular benzoic acid, optionally one or more usual perfume oils and/or optionally one or more usual dyes.

The inventive cleanser preferably contains the pyrogenic silicic acid in a quantity of 1.0 to 5.0%, specifically 1.8 to 2.5%, based on the total weight of the cleanser.

The organic acid is preferably contained in the inventive cleanser in a quantity of 1 to 40%, in particular 5 to 15%, based on the total weight of the cleanser.

The inventive cleanser preferably contains the abovementioned surface-active agent in a quantity of 0.5 to 5.0%, in particular 1.8 to 2.5%, based on the total weight of the cleanser.

The glycol, which can be contained in the inventive cleanser as an optional component, preferably exists in a quantity of 1 to 10%, in particular 1.5 to 5%, based on the total weight of the cleanser.

If the inventive cleanser contains a preservative and optionally a perfume oil and optionally a dye, these components are preferably present in a quantity of 0.2 to 1.0% (preservative) and a total quantity of 0 to 2%, in particular up to 0.5% (perfume and dye), based on the total weight of the cleanser in each case.

If the inventive cleanser contains a fatty alcohol ethoxylate as a surface-active agent, this is preferably one with an ethylene oxide content of 2 to 12 mol, preferably 3 mol, which is present in a quantity of preferably 0.1 to 2%, in particular 0.5 to 1%, based on the total weight of the cleanser.

An especially preferred inventive cleanser has the following composition, based on the total weight of the cleanser:

about 2.2% pyrogenic silicic acid
about 2.0% glycol
about 0.3% preservative (preferably benzoic acid)
about 7.0% citric acid
about 2.0% alkylamidopropyl betaine (30%)
about 0.5% perfume oil and dye
balance water.

According to a further aspect the present invention relates to the use of the above-described cleanser as a liquid sanitary cleaning agent, in particular for cleaning toilets, washbowls, shower cabinets, shower tubs and swimming pools as well as sinks in kitchens and labs.

With the inventive liquid cleaning agent one can increase the lime solvent power (LSP) by approx. 20% to 50% over toilet cleansers on the market, as indicated by the following survey of LSP values which were determined by the method of quality recommendation for acidic toilet cleansers (of the Industrieverband Putz- and Pflegemittel e.V. in the version of 1993) and classified as follows:

LSP>1.3=very good

LSP 0-7-1.3=satisfactory

LSP<0.7=inadequate

Comparison of LSP values of inventive cleansers and prior art cleansers a) Inventive cleansers

| | |
|---|---|
| Inventive cleanser with abovementioned composition | LSP value 1.44 (very good) |
| Inventive cleanser with same composition as above but with alkylbetaine instead of alkylamidopropyl betaine | LSP value 1.71 (very good) |
| Inventive cleanser with same composition as above but with alkyl polyglycol ether carboxylic acid instead of alkylamidopropyl betaine | LSP value 1.91 (very good) |

b) Comparable values for commercial products (liquid toilet cleansers based on organic carboxylic acid with the exception of formic acid):

| | |
|---|---|
| WC-frisch | LSP value 1.13 (satisfactory) |
| 00 Plus Formel | LSP value 1.05 (satisfactory) |
| Frosch Essigreiniger | LSP value 1.21 (satisfactory) |
| Tarax | LSP value 1.11 (satisfactory) |
| WC Ente, green | LSP value 1.22 (satisfactory) |
| Clinär | LSP value 0.98 (satisfactory) |

The inventive liquid cleanser thus has clearly improved LSP values over the prior art, which were unforeseeable for the expert in the field. This is presumably due to the fact that the liquid no longer runs away from the vertical surfaces during cleaning so that the exposure time and exposure concentration of the lime solvents is clearly increased while the diffusion of lime solvent on the surface to be treated is simultaneously improved.

Conversely, if limited demands are made on lime solvent power the concentration of lime-dissolving agent can be clearly reduced and the environmental acceptability of the inventive liquid cleanser thereby improved further, or stronger lime-dissolving acids can be used in lower concentration with environmental acceptability still being sufficient.

The inventive liquid cleanser with thixotrope properties can expediently be applied uniformly to the surface to be cleaned from a spray container with a spherical spray head having preferably four holes disposed each perpendicular thereon. The inventive liquid cleanser becomes temporarily thinner by being sprayed and assumes a thicker consistency again when hitting the surface to be cleaned, so that the inventive liquid cleanser can be applied to the surface to be cleaned in a better-sticking, thicker layer without the above-mentioned problems with respect to distribution and diffusion properties occurring.

I claim:

1. A liquid cleanser with thixotrope properties which contains a surface-active agent and an organic acid in an aqueous solution, consisting essentially of about 0.5 to 5 wt. % of a surface-active agent of one or more compounds selected from the group consisting of alkylamidobetaines, alkylaminobetaines, alkylbetaines, alkyl polyglycol ether carboxylic acids and fatty alcohol ethoxylates in mixture with about 1.0 to about 5 wt. % of pyrogenic silicic acid about 1 to 40 wt. % of at least one organic acid selected from the group consisting of citric acid, lactic acid, tartaric acid, maleic acid, malic acid, glutaric acid, adipic acid, acetic acid and formic acid, and benzoic acid as a preservative.

2. The cleanser of claim 1, wherein the alkyl group or fatty acid group of the surface-active agents is a saturated or unsaturated alkyl group with 10 to 18 carbon atoms.

3. The cleanser of claim 2, wherein the surface active agents selected from the group consisting of alkyl polyglycol ether carboxylic acids and fatty alcohol ethoxylates have 2 to 15 ethylene oxide units per molecule.

4. The cleanser of claim 3, wherein the surface-active agent it contains is alkylamidopropyl betaine.

5. The cleanser of claim 4, wherein the organic acid it contains is citric acid.

6. The cleanser of claim 5, wherein the pyrogenic silicic acid it contains is selected from the group consisting of Aerosil.

7. The cleanser of claim 6, wherein it additionally contains glycol, a preservative, a perfume oil and a dye.

8. The cleanser of claim 7 wherein the preservative is benzoic acid.

9. The cleanser of claim 7 wherein it contains pyrogenic silicic acid in a quantity of 1.8 to 2.5%, based on the total weight of the cleanser.

10. The cleanser of claim 9 wherein it contains the organic acid in a quantity of 5 to 15% based on the total weight of the cleanser.

11. The cleanser of claim 10, wherein it contains the surface-active agent in a quantity of 1.8 to 2.5% based on the total weight of the cleanser.

12. The cleanser of claim 11, wherein it contains glycol in a quantity of 1 to 10% based on the total weight of the cleanser.

13. The cleanser of claim 12, wherein it contains the preservative benzoic acid, in a quantity of 0.2 to 1% perfume oil and dye in a total quantity of 0 to 2% based on the total weight of the cleanser.

14. The cleanser of claim 13, wherein it contains a fatty alcohol ethoxylate with an ethylene oxide content of 2 to 12 mol in a quantity of 0.1 to 2% based on the total weight of the cleanser.

15. The cleanser of claim 14, wherein the composition of said cleanser (based on the total weight of the cleanser) is:

about 2.2% pyrogenic silicic acid about 2.0% glycol about 0.3% preservative about 7.0% citric acid about 2.0% alkylamidopropyl betaine (30%)

about 0.5% perfume oil and dye balance water.

16. Use of the cleanser of claim 1 as a liquid sanitary cleaning agent for cleaning toilets.

17. Use of the liquid cleanser of claim 1 for cleaning washbowls, shower cabinets, shower tubs and swimming pools as well as kitchen sinks.

* * * * *